US007547199B1

(12) United States Patent
Ross et al.

(10) Patent No.: US 7,547,199 B1
(45) Date of Patent: Jun. 16, 2009

(54) FLUID PUMPING SYSTEM AND RELATED METHODS

(76) Inventors: Anthony C. Ross, 3546 Maybank Hwy., John's Island, SC (US) 29455; Russel Ross, 5111 8th Rd. South, Apt 302, Arlington, VA (US) 22204

( * ) Notice: Subject to any disclaimer, the term of this patent is extended or adjusted under 35 U.S.C. 154(b) by 348 days.

(21) Appl. No.: 10/926,627

(22) Filed: Aug. 25, 2004

Related U.S. Application Data

(60) Provisional application No. 60/497,806, filed on Aug. 25, 2003, provisional application No. 60/497,836, filed on Aug. 25, 2003.

(51) Int. Cl.
*F04B 43/00* (2006.01)
*F04B 45/06* (2006.01)
*F04B 17/00* (2006.01)
*F01B 19/00* (2006.01)

(52) U.S. Cl. ..... 417/412; 417/340; 417/341; 417/478; 92/18; 92/22; 92/23; 92/50; 92/105

(58) Field of Classification Search ..... 92/23, 92/52, 50, 18, 22, 105; 417/273, 392, 394, 417/412, 478, 340, 341
See application file for complete search history.

(56) References Cited

U.S. PATENT DOCUMENTS

| | | | | |
|---|---|---|---|---|
| 1,546,973 | A | 7/1925 | Ellis | |
| 2,056,475 | A | 10/1936 | Marx | |
| 2,726,624 | A | 12/1955 | Raicy | |
| 2,807,216 | A | 9/1957 | Bielstein | |
| 2,815,715 | A | 12/1957 | Tremblay | |
| 2,971,471 | A | 2/1961 | Huebschman | |
| 3,048,121 | A | 8/1962 | Sheesley | |
| 3,062,002 | A * | 11/1962 | Shaffer | 60/221 |
| 3,074,351 | A | 1/1963 | Foster | |
| 3,136,257 | A | 6/1964 | Smith et al. | |
| 3,190,229 | A | 6/1965 | Turowski | |
| 3,194,170 | A * | 7/1965 | Ulbing | 417/394 |
| 3,215,084 | A | 11/1965 | Cline | |
| 3,216,413 | A | 11/1965 | Mota | |
| 3,307,358 | A | 3/1967 | Roche Kerandraon | |
| 3,359,735 | A | 12/1967 | Yeager, Sr. | |
| 3,552,408 | A * | 1/1971 | Dowdican et al. | 137/13 |
| 3,677,667 | A * | 7/1972 | Morrison | 417/474 |
| 3,765,175 | A | 10/1973 | Ohnaka | |
| 3,783,453 | A | 1/1974 | Bolie | |
| 3,826,217 | A | 7/1974 | Canova | |
| 3,836,289 | A | 9/1974 | Wolford et al. | |

(Continued)

FOREIGN PATENT DOCUMENTS

| | | |
|---|---|---|
| DE | 3004109 | 8/1981 |

(Continued)

OTHER PUBLICATIONS ("articulate.") Dictionary.com Unabridged (v.1.1). Random House, Inc. Dec. 29, 2008. <Dictionary.com http://dictionary.reference.com/browse/articulate>).*

*Primary Examiner*—Devon C Kramer
*Assistant Examiner*—Leonard J Weinstein

(57) ABSTRACT

A pumping system and related methods involving an outer chamber and an inner chamber extending between two end-plates, wherein the circumference of the inner chamber may be adjusted via a plurality of ribs and linear motors.

43 Claims, 5 Drawing Sheets

U.S. PATENT DOCUMENTS 3,839,983 A 10/1974 McAusland
3,945,201 A 3/1976 Entringer
4,026,235 A 5/1977 Woodfill
4,031,844 A 6/1977 Onal et al.
4,076,467 A 2/1978 Persson
4,389,169 A 6/1983 De Dionigi
4,424,009 A 1/1984 Van Os
4,439,112 A 3/1984 Kitsnik
4,449,893 A * 5/1984 Beckman et al. ..... 417/322
4,488,854 A 12/1984 Miller
4,541,891 A * 9/1985 Leatherman ..... 156/379.6
4,744,900 A * 5/1988 Bratt ..... 210/321.78
4,787,823 A 11/1988 Hultman
4,925,377 A 5/1990 Inacio et al.
5,085,563 A 2/1992 Collins et al.
5,108,426 A 4/1992 Biro et al.
5,209,654 A 5/1993 Nilsson et al.
5,298,818 A 3/1994 Tada
5,327,041 A * 7/1994 Culp ..... 310/328
5,333,444 A 8/1994 Meng
5,401,195 A 3/1995 Yocom
5,411,381 A 5/1995 Perrodin
5,567,131 A 10/1996 McNaull
5,620,048 A 4/1997 Beauquin
5,676,162 A 10/1997 Larson, Jr. et al.
5,676,651 A 10/1997 Larson, Jr. et al.
5,693,091 A 12/1997 Larson, Jr. et al.
5,717,259 A * 2/1998 Schexnayder ..... 310/11
5,722,930 A 3/1998 Larson, Jr. et al.
5,758,666 A 6/1998 Larson, Jr. et al.
5,792,106 A * 8/1998 Mische ..... 604/103.01
5,879,375 A 3/1999 Larson, Jr. et al.
5,915,930 A 6/1999 McNaull
5,964,580 A * 10/1999 Taga ..... 417/394
6,000,353 A 12/1999 De Leu
6,012,910 A 1/2000 McNaull
6,050,787 A * 4/2000 Hesketh ..... 417/412
6,273,015 B1 8/2001 Motsenbocker et al.
6,273,771 B1 8/2001 Buckley et al.
6,318,237 B1 * 11/2001 Muller ..... 92/23
6,352,455 B1 * 3/2002 Guagliano et al. ..... 440/38
6,464,476 B2 * 10/2002 Ross et al. ..... 417/478
6,547,749 B2 * 4/2003 Hansen ..... 601/48
6,575,715 B1 * 6/2003 Rastegar ..... 417/413.2
6,607,368 B1 * 8/2003 Ross et al. ..... 417/412
7,445,531 B1 * 11/2008 Ross et al. ..... 440/38
2002/0098098 A1 * 7/2002 Miesner ..... 417/477.1
2002/0195252 A1 * 12/2002 Maguire et al. ..... 166/380

FOREIGN PATENT DOCUMENTS

JP 0115906 10/1978

* cited by examiner

-PRIOR ART-

FLUID PUMPING SYSTEM AND RELATED METHODS

CROSS-REFERENCES TO RELATED APPLICATIONS

The present application is a US Non-Provisional Patent Application of and claims the benefit of priority from commonly owned and co-pending U.S. Provisional Patent Application Ser. No. 60/497,806 (filed Aug. 25, 2003) and Ser. No. 60/497,836 (filed Aug. 25, 2003), the entire contents of which are hereby expressly incorporated by reference into this disclosure as if set forth fully herein.

BACKGROUND OF THE INVENTION

I. Field of the Invention

The present invention relates generally to pumps and, more particularly, to pumping system and related methods involving an outer chamber and an inner chamber extending between two endplates, wherein the circumference of the inner chamber may be adjusted via a plurality of ribs and linear motors.

II. Discussion of the Prior Art

Pumps have been used for centuries, and various types of pumps have been devised, including positive displacement pumps, rotary pumps, vane pumps, and centrifugal pumps. While many of these pumps are well suited for particular uses, pumps in general do not have a high efficiency, and are not well suited for special applications, such as pumping blood or pumping sewage wastewater.

Current pumps include the crew of Archimedes that interferes with axial blood flow. Many pumps cause damage to the blood components as these blood components make either direct or near contact that surfaces of the pump. Ventricular assist pumps currently employ mechanisms to move blood that stresses the blood in some situations and are non-pulsatile.

When pumping blood, constant flow by conventional pumps may cause "pumphead" because of the sustained vasodilation. The alterations in the cellular components of the blood, typical with rotary and constant flow pumps, may be due to reactions with the vasodilated capillaries and the components of the blood reacting to this abnormal state. Ischemia may be present to the decreased lumen secondary to an accumulation of platelets and/or the blood not pulsing enough to create turbulence and transfer the gases and nutrients. This would thus be analogous to going too fast by a road sign. It may be due to the hemodynamics of fluid flow with a non-newtonian fluid. The pulse flow preferably allows for a psychological pause in the short duration dilated phase and the contraction may facilitate the movement of the blood components.

Various types of linear pumps have been devised, including linear pumps particularly intended for pumping blood. U.S. Pat. Nos. 5,676,162 and 5,879,375 disclose reciprocating pump and linear motor arrangements for pumping blood. The assembly includes a piston-valve which is placed at the inlet end of a hollow chamber. The valve leaflets may be in any arbitrary position. The pump module arrangement may occupy a space of no more than approximately 6 cm. in diameter and 7.5 cm. long. In a preferred embodiment, a quick connect locking system may be utilized, as shown in FIG. 3 of the '162 patent. FIG. 11 of the '375 patent illustrates the anatomical arrangement of a surgically implantable pump with a reciprocating piston-valve. Other patents directed to implantable pumps and or linear pumps include U.S. Pat. Nos. 5,676,651, 5,693,091, 5,722,930, and 5,758,666.

Conventional pumps have long been used to pump a slurry consisting of a fluid and a semi-solid material, which is common in sewage wastewater. Conventional wastewater pumps have significant problems due to pump plugging and abrasion, which increases repair and maintenance costs, and results in poor pump efficiency and/or short pump life.

The disadvantages of the prior art are either overcome or are reduced by the present invention, and improved linear pumps and methods of pumping fluids are hereinafter disclosed which overcome many of the disadvantages of prior art pumps, including relatively high cost of manufacture and/or poor pump efficiency.

The present invention is directed at overcoming, or at least improving upon, the disadvantages of the prior art.

SUMMARY OF THE INVENTION

The present invention is directed to a highly versatile linear pump of a type generally shown and described in U.S. Pat. Nos. 6,352,455 and 6,607,368, the entire contents of which are hereby incorporated into this disclosure as if set forth in their entirety herein. The linear pump of the present invention is similar to the linear pumps of the '455 and '368 patents in that it includes an inner chamber disposed within an outer chamber, each having one or more inlets and outlets for passing fluid into and out of each respective chamber to pump fluid. The present invention is different from (and improved relative to) the linear pump of the '455 and '368 patents in that the outer chamber and inner chamber are both generally rigid, wherein the circumference of the inner chamber may be adjusted via a plurality of generally rigid ribs and linear motors, and the end plates do NOT move relative to one another. The linear pump of the present invention may find use in any number of fluid pumping and/or vehicle propulsion applications, including but not limited to pumping water, air, etc. . . . for any of a variety of marine, medical, industrial, governmental and/or recreational uses.

In a preferred embodiment, the outer chamber of the linear motor of the present invention is generally rigid, and includes a plurality of intake ports to permit fluid to enter into the outer chamber (including but not limited to one-way check valves) and a plurality of outlet ports to permit movement of the fluid or relative fluid of the device (including but not limited to one-way check valves). The inner chamber is constructed from a plurality of generally rigid plate members or "slat-like" ribs which run the length of the pumping system of the present invention. Each rib member cooperates with one or more linear motors such that the rib members may be selectively forced in a radial (i.e. outward) direction and medial (i.e. inward) direction.

To facilitate this radial and medial motion, each rib member is equipped with an articulating member which engages into a groove formed within an adjacent rib member and forms an articulate joint. Preferably, both the rib members and the articulating members are generally curved such that the inner chamber is generally cylindrical. As the linear motors are operated, the rib members are caused to expand and contract within the generally rigid outer chamber. In a preferred embodiment, the linear motors include permanent magnets, but any of a variety of suitable linear drive mechanisms may be employed without departing from the scope of the present invention, including but not limited to hydraulic and pneumatic. To ensure no pressure loss during operation, the articulating member may be equipped with any of a variety of sealing features, including but not limited to O-rings or the like to prevent the passage of fluid in between the adjacent rib members during contraction and/or expansion.

One advantage of this design is that, unlike the linear pump systems shown and described in U.S. Pat. No. 6,352,455 or 6,607,368 (the entire contents of which are hereby incorporated into this disclosure as if set forth fully herein), is that the inner chamber is not a bladder which will stretch and recover. The power is 90-degree opposition, which provides close to a 100% power exchange instead of the 70% with the flexible bladder of the '455 or '638 patents. This is a significant distinction in that it will allow the device of the present invention, when attached to a vehicle of appropriate size and construction, to actually propel the vehicle from a position on top of or under the water to an airborne state out of the water.

BRIEF DESCRIPTION OF THE DRAWINGS

Many advantages of the present invention will be apparent to those skilled in the art with a reading of this specification in conjunction with the attached drawings, wherein like reference numerals are applied to like elements and wherein.

DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. The linear pump of the present invention disclosed herein boasts a variety of inventive features and components that warrant patent protection, both individually and in combination.

Figure 10:
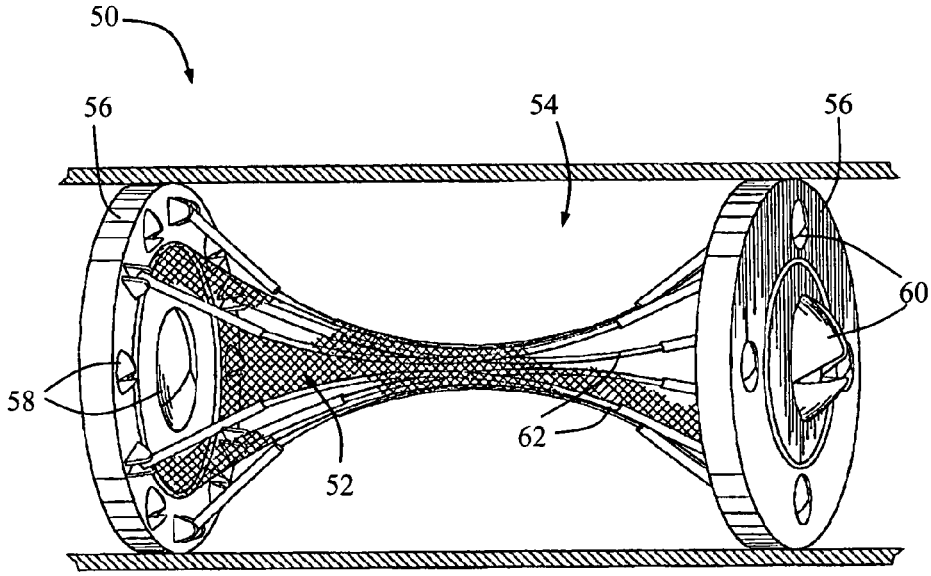
FIG. 10 is a perspective view of a prior art linear pump having a flexible inner chamber, the pump presented in partial cross-section in a condensed bladder configuration, such as after discharging fluid from the inner chamber of the bladder.
Figure 11:
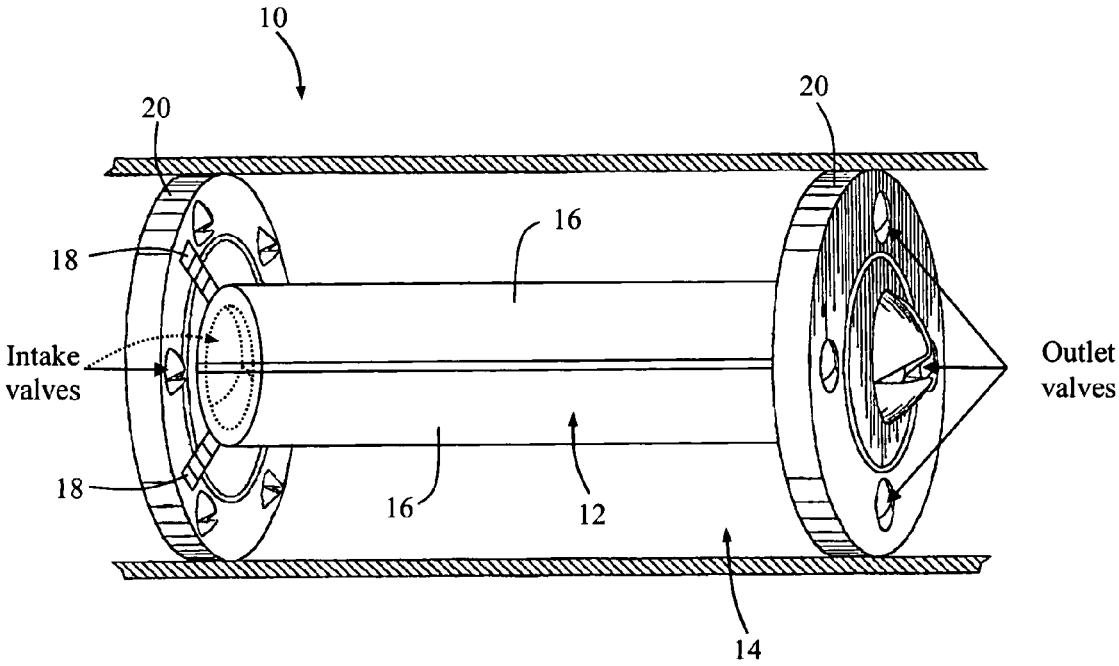
FIG. 11 is a Perspective view of the linear pump of FIG. 10 after modification to include a generally rigid inner chamber of the present invention.

Referring first to FIG. 10, there is shown a depiction of a linear pump 50 as shown and described in detail in U.S. Pat. No. 6,607,368. The linear pump 50 includes an inner chamber 52 and an outer chamber 54. The linear pump 50 also includes end plates 56 having a plurality of intake valves 58 and/or outlet valves 60. Notably, the linear pump 50 further includes a plurality of flexible rib members 62 such that inner chamber comprises a flexible bladder which will stretch and recover.

FIGS. 1-4 and 11 depict a linear pump 10 according to one embodiment of the present invention. The pump 10 is of a type generally shown and described in U.S. Pat. Nos. 6,352,455 and 6,607,368, the entire contents of which are hereby incorporated into this disclosure as if set forth in their entirety herein. The linear pump 10 of the present invention is similar to the linear pumps of the '455 and '368 patents in that it includes an inner chamber 12 disposed within an outer chamber 14, each having one or more inlets and outlets for passing fluid into and out of each respective chamber to pump fluid. The present invention is different from (and improved relative to) the linear pump of the '455 and '368 patents in that the outer chamber 14 and inner chamber 12 are both generally rigid, wherein the circumference of the inner chamber 12 may be adjusted via a plurality of generally rigid ribs 16 and linear motors 18, and the end plates 20 do NOT move relative to one another. The linear pump 10 of the present invention may find use in any number of fluid pumping and/or vehicle propulsion applications, including but not limited to pumping water, air, etc. . . . for any of a variety of marine, medical, industrial, governmental and/or recreational uses.

In a preferred embodiment, the outer chamber 14 of the linear pump 10 of the present invention is generally rigid, and includes a plurality of intake ports to permit fluid to enter into the outer chamber (including but not limited to one-way check valves) and a plurality of outlet ports to permit movement of the fluid or relative fluid of the device (including but not limited to one-way check valves). The inner chamber 12 is constructed from a plurality of generally rigid plate members or "slat-like" ribs 16 which run the length of the pumping system of the present invention. Each rib member 16 cooperates with one or more linear motors 18 such that the rib members 16 may be selectively forced in a radial (i.e. outward) direction and medial (i.e. inward) direction.

To facilitate this radial and medial motion, each rib member 16 is equipped with an articulating member 22 which engages into a groove 24 formed within an adjacent rib member 16 and forms an articulated joint. Preferably, both the rib members 16 and the articulating members 22 are generally curved such that the inner chamber 12 is generally cylindrical. As the linear motors 18 are operated, the rib members 16 are caused to expand and contract within the generally rigid outer chamber 14. In a preferred embodiment, the linear motors 18 include permanent magnets, but any of a variety of suitable linear drive mechanisms may be employed without departing from the scope of the present invention, including but not limited to hydraulic and pneumatic systems. To ensure no pressure loss during operation, the articulating member may be equipped with any of a variety of sealing features, including but not limited to O-rings or the like to prevent the passage of fluid in between the adjacent rib members 16 during contraction and/or expansion.

One advantage of this design is that, unlike the linear pump systems shown and described in U.S. Pat. No. 6,352,455 or 6,607,368 (the entire contents of which are hereby incorporated into this disclosure as if set forth fully herein), the inner chamber 12 is not a bladder which will stretch and recover. The power is 90-degree opposition, which provides close to a 100% power exchange instead of the 70% with the flexible bladder of the '455 or '638 patents. This is a significant distinction in that it will allow the pump 10 of the present invention, when attached to a vehicle of appropriate size and construction, to actually propel the vehicle from a position on top of or under the water to an airborne state out of the water.

Figure 1:
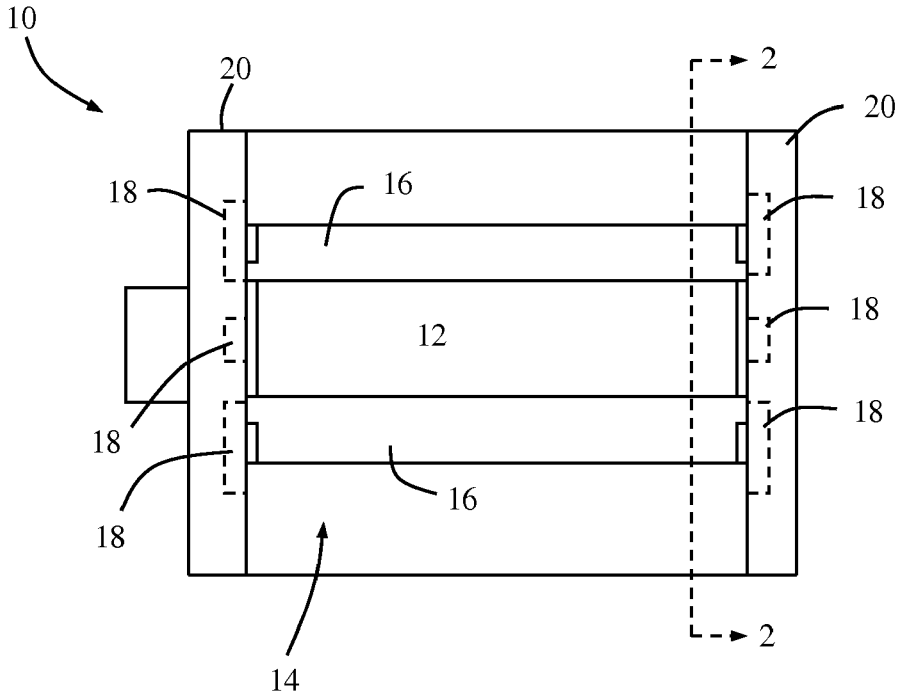
FIG. 1 is a side view of a linear pump of the present invention.
Figure 2A:
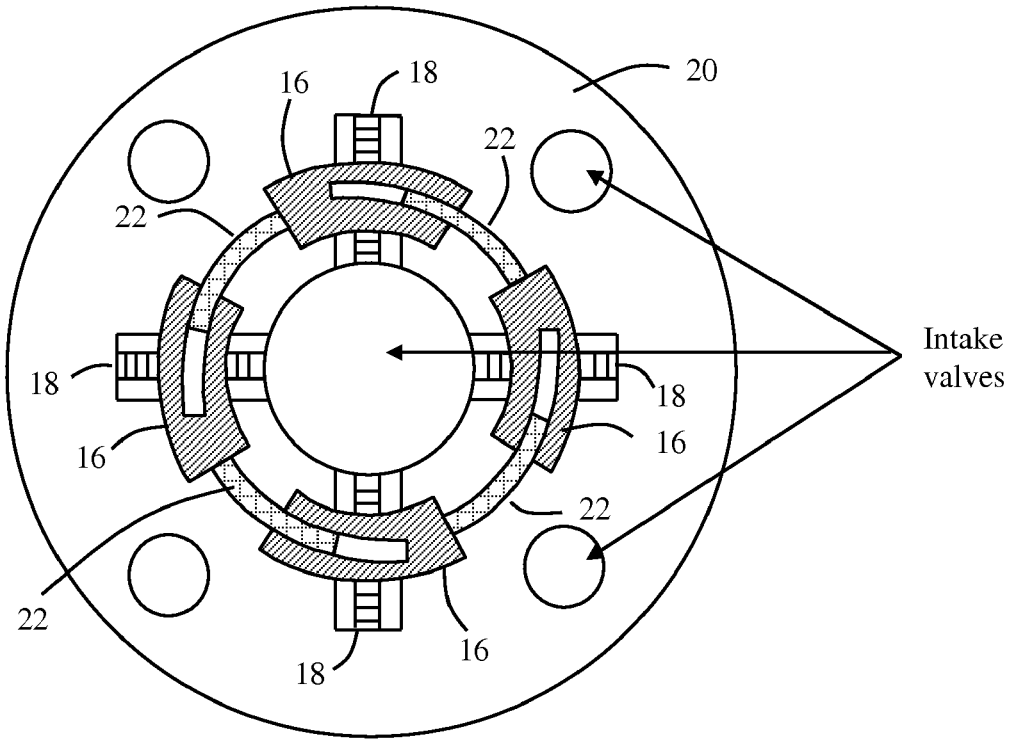
FIG. 2A is a cross-sectional view of the linear pump of the present invention taken along line 2-2 in FIG. 1.
Figure 2B:
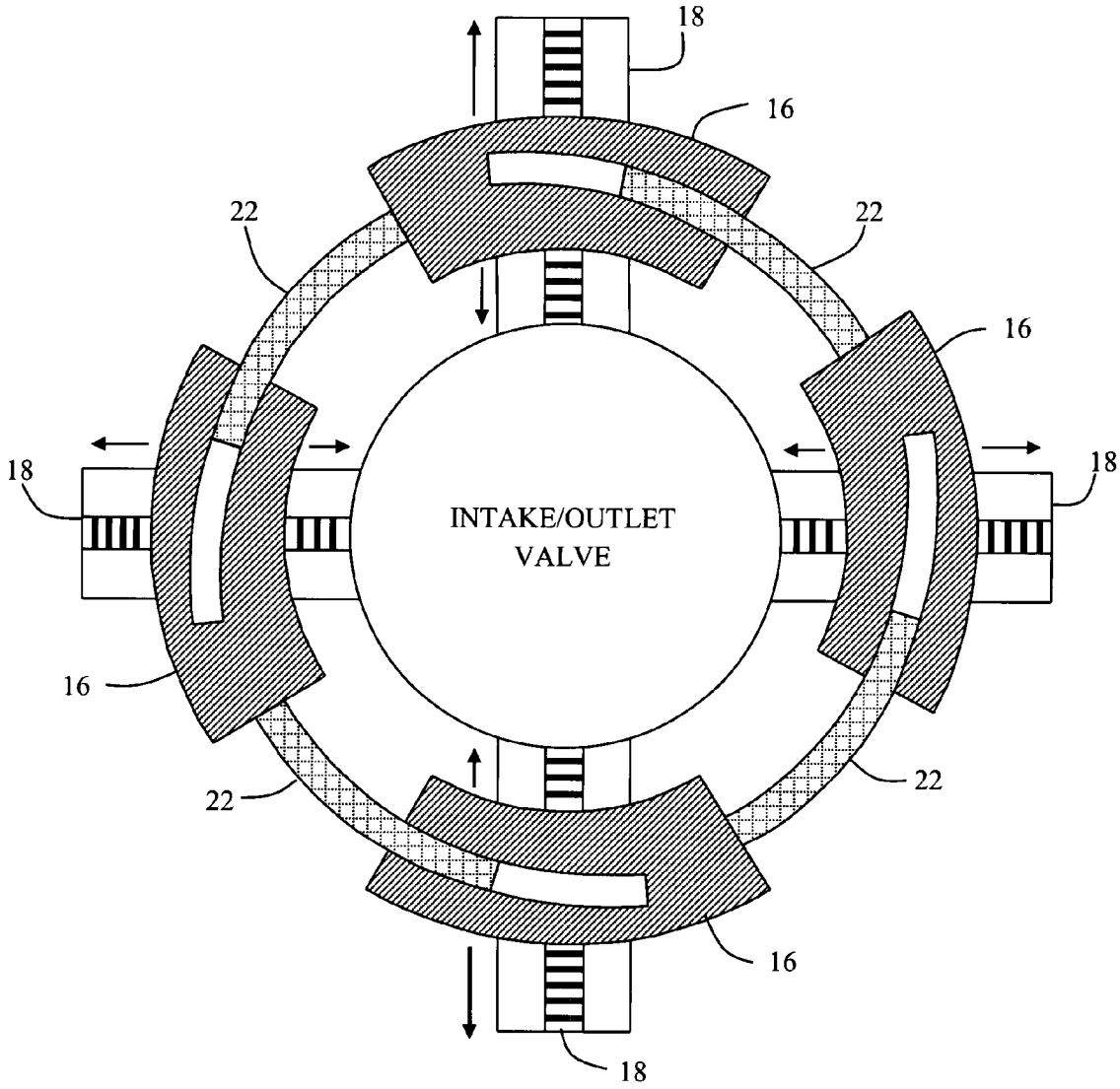
FIG. 2B is a partial cross-sectional view of the linear pump of the present invention taken along line 2-2 in FIG. 1.
Figure 3:
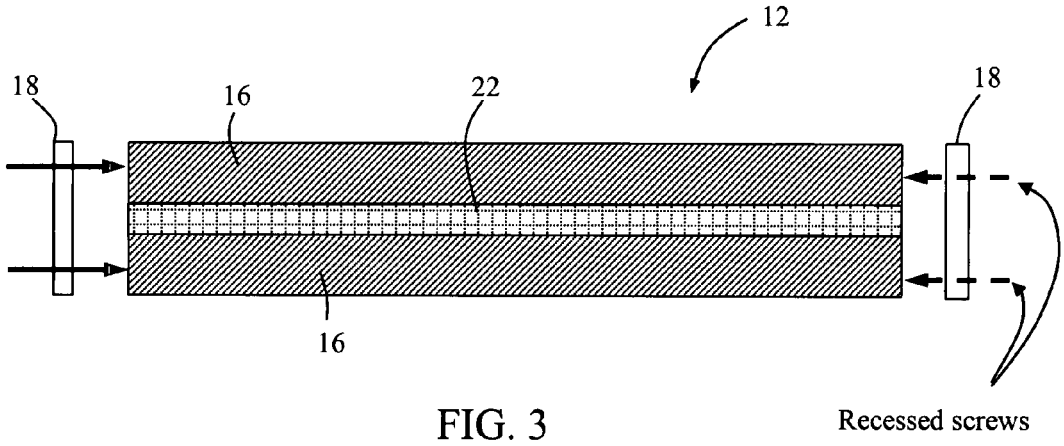
FIG. 3 is an exploded view of the inner chamber of the linear pump of the present invention.
Figure 4:
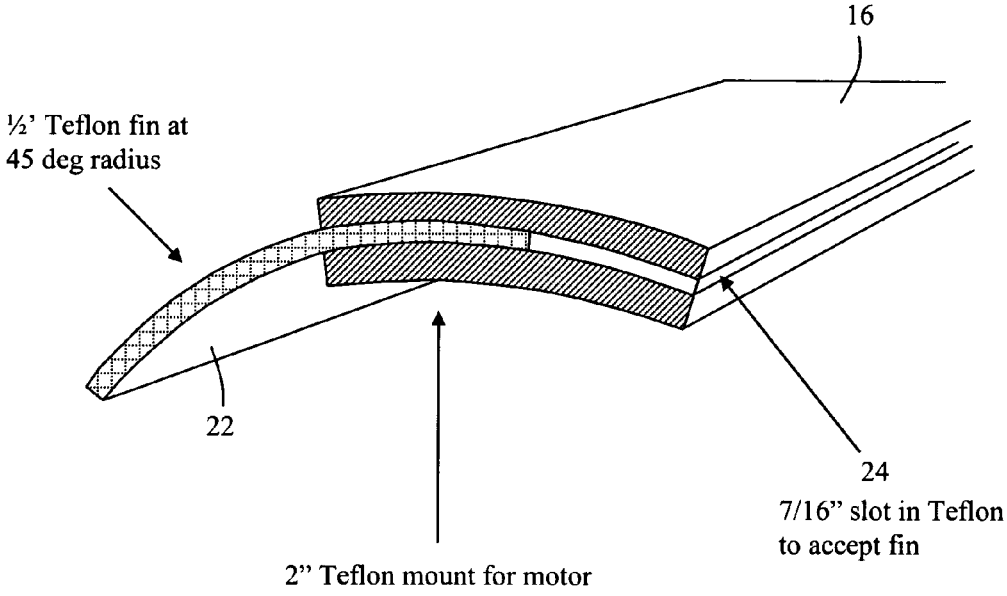
FIG. 4 is an exploded view of a rib member forming part of the inner chamber of the linear pump of the present invention.
Figure 5:
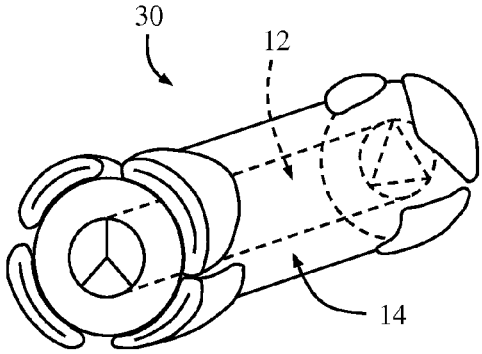
FIG. 5 is a perspective view of a linear pump according to another embodiment of the present invention.
Figure 6:
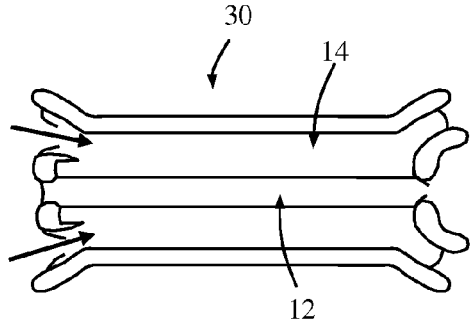
FIG. 6 is a side cross-sectional view of the linear pump of the present invention as shown in FIG. 5 illustrating the simultaneous "inner chamber fluid discharge" and "outer chamber fluid charge" according to the present invention.
Figure 7:
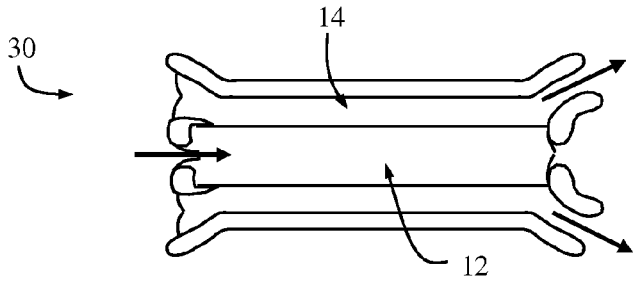
FIG. 7 is a side cross-sectional view of the linear pump of the present invention as shown in FIG. 5 illustrating the simultaneous "outer chamber fluid discharge" and "inner chamber fluid charge" according to the present invention.

FIGS. 5-9 illustrate the use of a linear pump 30 according to the present invention, the main difference between the pump 10 of FIGS. 1-4 being that the outer chamber 14 has inlets and outlets disposed along the outer periphery of the outer chamber 14. As shown in FIG. 6, the linear pump 30 of the present invention (along with the embodiment shown in FIGS. 1-4) is capable of simultaneously discharging the fluid within the inner chamber while fluid is charged or delivered into the outer chamber according to the present invention. The inverse is also true, as shown in FIG. 7 (and as it is for the embodiment shown in FIGS. 1-4), wherein the linear pump of the present invention is capable of simultaneously discharging the fluid within the outer chamber while fluid is charged or delivered into the inner chamber according to the present invention.

Figure 8:
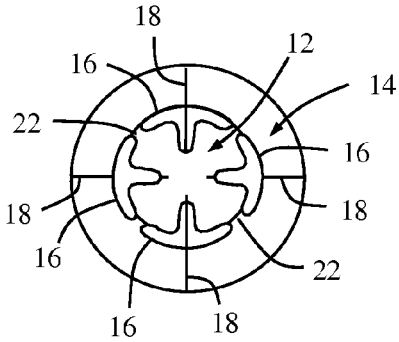
FIG. 8 is a side view of the linear pump of the present invention as shown in FIG. 5 illustrating the inner chamber in the contracted state.
Figure 9:
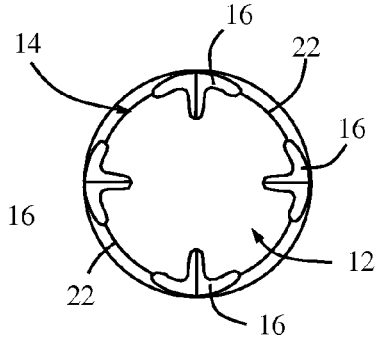
FIG. 9 is a side view of the linear pump of the present invention as shown in FIG. 5 illustrating the inner chamber in the expanded state.

FIG. 8 is a side view of the linear pump of the present invention as shown in FIG. 5 illustrating the inner chamber in the contracted state. FIG. 9 is a side view of the linear pump of the present invention as shown in FIG. 5 illustrating the inner chamber in the expanded state.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the invention is to cover all modifications, equivalents, and alternatives falling within the spirit and scope of the invention as defined herein and claimed below.

The invention claimed is:

1. A fluid pumping system, comprising:

a generally rigid outer chamber having at least one fluid inlet and at least one fluid outlet; and an inner chamber disposed within said outer chamber, said inner chamber having at least one fluid inlet, at least one fluid outlet, and a plurality of generally rigid articulating walls coupled together via articulating joints to provide of bi-directional radial movement of said walls to expand and contract the volume of said inner chamber and facilitate the influx of fluid through said fluid inlet of said inner chamber and expulsion of fluid through said fluid outlet of said inner chamber.

2. The fluid pumping system of claim 1 and further, wherein a circumference of said inner chamber is adjusted by coupling said plurality of generally rigid walls to a motor.

3. The fluid pumping system of claim 2 and further, wherein said motor is a linear motor.

4. The fluid pumping system of claim 1 and further, comprising a first end plate and a second end plate, wherein said outer chamber and said inner chamber extend between said first end plate and said second end plate.

5. The fluid pumping system of claim 4 and further, wherein said first and second end plates are generally stationary relative to one another.

6. The fluid pumping system of claim 1 and further, wherein at least one of said at least one fluid inlet and said at least one fluid outlet of said outer chamber is one-way check valve.

7. The fluid pumping system of claim 1 and further, wherein at least one of said at least one fluid inlet and said at least one fluid outlet of said inner chamber is one-way check valve.

8. The fluid pumping system of claim 2 and further, wherein said walls comprise longitudinally disposed ribs, each of said ribs being coupled to said motor.

9. The fluid pumping system of claim 8 and further, wherein said longitudinally disposed ribs comprise at least a first rib and an adjacent second rib, said first rib comprising an articulating member extending outwardly and comprising a first edge, said second rib comprising a receiving portion including a second edge, said first edge of said first rib configured to overlap said second edge of said second rib when said articulating member of said first rib is received by said receiving portion of said second rib upon assembly of said inner chamber to form one of said articulating joints and facilitate translation of said first and second ribs relative to one another.

10. The fluid pumping system of claim 9 and further, wherein said inner chamber is generally cylindrical.

11. A method of pumping fluid, comprising the steps of:

disposing an inner chamber within a generally rigid outer chamber, said inner chamber having a plurality of generally rigid articulating walls coupled together via articulating joints to provide bi-directional radial movement of said walls, wherein each of said outer chamber and inner chamber has at least one fluid inlet and at least one fluid outlet; and changing the volume within said inner chamber relative to said outer chamber by adjusting the circumference of said inner chamber by radially migrating said plurality of generally rigid articulating walls to force fluid from said fluid inlet of said inner chamber to said fluid outlet of said inner chamber.

12. The method of pumping fluid of claim 11 and further, wherein said circumference of said inner chamber is adjusted by coupling said plurality of generally rigid walls to a motor.

13. The method of pumping fluid of claim 12 and further, wherein said motor is a linear motor.

14. The method of pumping fluid of claim 11 and further, including the step of providing a first end plate and a second end plate, wherein said outer chamber and said inner chamber extend between said first end plate and said second end plate.

15. The method of pumping fluid of claim 14 and further, wherein said first and second end plates are generally stationary relative to one another.

16. The method of pumping fluid of claim 11 and further, wherein at least one of said at least one fluid inlet and said at least one fluid outlet of said outer chamber is one-way check valve.

17. The method of pumping fluid of claim 11 and further, wherein at least one of said at least one fluid inlet and said at least one fluid outlet of said inner chamber is one-way check valve.

18. The method of pumping fluid of claim 12 and further, wherein said walls comprise longitudinally disposed ribs, each of said ribs being coupled to said motor.

19. The method of pumping fluid of claim 18 and further, wherein said longitudinally disposed ribs comprise at least a first rib and an adjacent second rib, said first rib comprising an articulating member extending outwardly and comprising a first edge, said second rib comprising a receiving portion including a second edge, said first edge of said first rib configured to overlap said second edge of said second rib when said articulating member of said first rib is received by said receiving portion of said second rib upon assembly of said inner chamber to form one of said articulating joints and facilitate translation of said first and second ribs relative to one another.

20. The method of pumping fluid of claim 19 and further, wherein said inner chamber is generally cylindrical.

21. A fluid pumping system, comprising:

a generally rigid outer chamber having at least one fluid inlet and at least one fluid outlet;

a generally cylindrical inner chamber disposed within said outer chamber, said inner chamber having at least one fluid inlet, at least one fluid outlet, and a plurality of generally rigid articulating walls defining a circumference of said inner chamber, said walls coupled together via articulating joints to provide bi-directional radial movement of said walls; and at least one linear motor coupled to at least one of said plurality of generally rigid walls such that actuation of said linear motor causes said bi-directional radial movement of said walls such that the circumference of said inner chamber at least one of increases and decreases uniformly along a longitudinal axis and facilitates at least one of the influx of fluid through said fluid inlet of said inner chamber and expulsion of fluid through said fluid outlet of said inner chamber.

22. The fluid pumping system of claim 21 and further, comprising a first end plate and a second end plate, wherein said outer chamber and said inner chamber extend between said first end plate and said second end plate.

23. The fluid pumping system of claim 22 and further, wherein said first and second end plates are generally stationary relative to one another.

24. The fluid pumping system of claim 21 and further, wherein at least one of said at least one fluid inlet and said at least one fluid outlet of said outer chamber is one-way check valve.

25. The fluid pumping system of claim 21 and further, wherein at least one of said at least one fluid inlet and said at least one fluid outlet of said inner chamber is one-way check valve.

26. The fluid pumping system of claim 21 and further, wherein said walls comprise longitudinally disposed ribs, each of said ribs being coupled to said motor.

27. The fluid pumping system of claim 26 and further, wherein said longitudinally disposed ribs comprise at least a first rib and an adjacent second rib, said first rib comprising an articulating member extending outwardly and comprising a first edge, said second rib comprising a receiving portion including a second edge, said first edge of said first rib configured to overlap said second edge of said second rib when said articulating member of said first rib is received by said receiving portion of said second rib upon assembly of said inner chamber to form one of said articulating joints and facilitate translation of said first and second ribs relative to one another.

28. A fluid pumping system, comprising:

a generally rigid outer chamber having at least one fluid inlet and at least one fluid outlet;

a generally cylindrical inner chamber disposed within said outer chamber, said inner chamber having at least one fluid inlet, at least one fluid outlet, and a plurality of generally rigid articulating walls defining a circumference of said inner chamber, said walls coupled together via articulating joints to provide bi-directional radial movement of said walls, said plurality of walls comprising at least a first wall having an articulating member extending outwardly and comprising a first edge and a second wall having a receiving portion including a second edge, said first edge configured to overlap said second edge upon assembly of said inner chamber to form one of said articulating joints and facilitate translation of said first and second walls relative to one another.

29. The fluid pumping system of claim 28, further comprising at least one linear motor coupled to at least one of said plurality of generally rigid walls such that actuation of said linear motor causes said bi-directional radial movement of said walls such that the circumference of said inner chamber at least one of increases and decreases uniformly along a longitudinal axis and facilitates at least one of the influx of fluid through said fluid inlet of said inner chamber and expulsion of fluid through said fluid outlet of said inner chamber.

30. The fluid pumping system of claim 29 and further, comprising a first end plate and a second end plate, wherein said outer chamber and said inner chamber extend between said first end plate and said second end plate.

31. The fluid pumping system of claim 30 and further, wherein said first and second end plates are generally stationary relative to one another.

32. The fluid pumping system of claim 29 and further, wherein said bi-directional radial movement of said walls of said inner chamber expands and contracts the volume of said outer chamber to facilitate the influx of fluid through said fluid inlet of said outer chamber and expulsion of fluid through said fluid outlet of said outer chamber.

33. The fluid pumping system of claim 32, wherein said influx of fluid through said fluid inlet of said outer chamber occurs simultaneously with said expulsion of fluid through said fluid outlet of said inner chamber.

34. The fluid pumping system of claim 32, wherein said influx of fluid through said fluid inlet of said inner chamber occurs simultaneously with said expulsion of fluid through said fluid outlet of said outer chamber.

35. The fluid pumping system of claim 28 and further, wherein at least one of said at least one fluid inlet and said at least one fluid outlet of said outer chamber is one-way check valve.

36. The fluid pumping system of claim 28 and further, wherein at least one of said at least one fluid inlet and said at least one fluid outlet of said inner chamber is one-way check valve.

37. The fluid pumping system of claim 1, wherein said bi-directional radial movement of said walls of said inner chamber expands and contracts the volume of said outer chamber to facilitate the influx of fluid through said fluid inlet of said outer chamber and expulsion of fluid through said fluid outlet of said outer chamber.

38. The fluid pumping system of claim 37, wherein said influx of fluid through said fluid inlet of said outer chamber occurs simultaneously with said expulsion of fluid through said fluid outlet of said inner chamber.

39. The fluid pumping system of claim 37, wherein said influx of fluid through said fluid inlet of said inner chamber occurs simultaneously with said expulsion of fluid through said fluid outlet of said outer chamber.

40. The method of claim 11, wherein radially migrating said plurality of generally rigid articulating walls forces fluid from said fluid inlet of said outer chamber to said fluid outlet of said outer chamber.

41. The fluid pumping system of claim 21, wherein said bi-directional radial movement of said walls of said inner chamber expands and contracts the volume of said outer chamber to facilitate the influx of fluid through said fluid inlet of said outer chamber and expulsion of fluid through said fluid outlet of said outer chamber.

42. The fluid pumping system of claim 41, wherein said influx of fluid through said fluid inlet of said outer chamber occurs simultaneously with said expulsion of fluid through said fluid outlet of said inner chamber.

43. The fluid pumping system of claim 41, wherein said influx of fluid through said fluid inlet of said inner chamber occurs simultaneously with said expulsion of fluid through said fluid outlet of said outer chamber.

* * * * *